US006152331A

United States Patent [19]

Clement

[11] Patent Number: 6,152,331

[45] Date of Patent: Nov. 28, 2000

[54] BILGE CLEANER DISPENSER

[75] Inventor: Pierre Clement, St. Jovite, Canada

[73] Assignee: Crew Cleaner, Inc., Fort Lauderdale, Fla.

[21] Appl. No.: 09/272,073

[22] Filed: Mar. 18, 1999

Related U.S. Application Data

[60] Provisional application No. 60/078,776, Mar. 19, 1998.

[51] Int. Cl.[7] ..... B67D 5/06

[52] U.S. Cl. ..... 222/181.3; 222/189.06; 222/420

[58] Field of Search ..... 222/181.3, 181.2, 222/189.07, 189.06, 547, 420

[56] References Cited

U.S. PATENT DOCUMENTS

| | | | |
|---|---|---|---|
| 553,752 | 1/1896 | Goff | 222/181.3 |
| 819,248 | 5/1906 | Organ | 222/181.3 |
| 1,284,035 | 11/1918 | Anderson | 222/181.2 |
| 2,798,230 | 7/1957 | Le Febvre et al. | 4/227 |
| 3,189,223 | 6/1965 | Mackal | 222/1 |
| 3,248,017 | 4/1966 | Allen | 222/189 |
| 5,921,443 | 6/1999 | McMillan | 222/174 |

*Primary Examiner*—Joseph A. Kaufman
*Assistant Examiner*—Melvin A. Cartagena
*Attorney, Agent, or Firm*—Malin, Haley & DiMaggio, P.A.

[57] ABSTRACT

A bilge cleaner dispenser and method of dispensing liquid bilge cleaner is provided that continuously dispenses a preselected amount of bilge cleaner over time into a bilge. A flow regulator is attached to the standard external threads of the mouth opening of a conventional container of bilge cleaner such that when the container is turned in an orientation that allows liquid flow by gravity, the liquid bilge cleaner drips out of the flow regulator into the bilge at a predetermined rate over time. The conventional container of liquid bilge cleaner is removably attached to a rigid support member. The support member is attachable to a rigid frame such as a suitable location of a boat, and maintains the container of bilge cleaner in an orientation such that the bilge cleaner drips out of the flow regulator directly into the boat's bilge at a predetermined rate.

17 Claims, 3 Drawing Sheets

BILGE CLEANER DISPENSER

CROSS-REFERENCE TO RELATED APPLICATIONS

This utility application is filed within one year of the filing of provisional application number 60/078,776 on Mar. 19, 1998.

BACKGROUND OF THE INVENTION

1. Field of the Invention

The present invention relates to a liquid bilge cleaner dispenser, and more particularly to a marine bilge cleaner dispenser and method for dispensing a bilge cleaner at a preselected continuous rate over time.

2. Description of Related Art

Bilge water is either fresh or salt water that accumulates in the bilge of boats either by rain, or by fresh or salt water taken on while underway, or by the washing of the boat and the like. Bilge water also contains contaminants such as engine, crankcase, and diesel oils either leaked or spilled into the bilge. Oil does not mix with the bilge water, but floats on the surface and is therefore more difficult to remove when the bilge water is pumped out.

Commercial products known in the art as bilge cleaners, are utilized to, among other things, disperse and absorb oils and other contaminants into an aqueous solution so they can be removed during pumping of the bilge water.

A problem exists with conventional dispensing of bilge cleaners. The bilge cleaner is manually poured from a container in a predetermined discrete amount into the bilge. The cleaner, which has the viscosity close to water mixes with the bilge water and contaminants forming the aqueous solution, and is pumped out in solution along with the bilge water and contaminants. In a short while, all of the bilge cleaner has been pumped out, wherein another discrete amount of cleaner must be manually poured into the bilge to provide cleaning.

The required frequency of cleaner dispensing is dependent on several variables such as the amount of water entering the bilge, the amount of oil and other contaminants entering the bilge, and the concentration of the cleaner. In addition, the boat owner or maintainer, must remember to periodically dispense the cleaner into the bilge.

What is needed is a bilge cleaner dispenser and method of dispensing that automatically dispenses a preselected amount of bilge cleaner into the bilge in a continuous rate over time.

BRIEF SUMMARY OF THE INVENTION

A liquid bilge cleaner dispenser and method of dispensing liquid bilge cleaner is provided that continuously dispenses a preselected amount of bilge cleaner over time into a bilge. A multi-piece dispenser is attached to the standard external threads of the mouth opening of a conventional bilge cleaner container such that when the container is turned upside-down, the liquid bilge cleaner drips out of the dispenser into the bilge at a predetermined rate over time.

A conventional container of liquid bilge cleaner is removably fastened to a rigid substantially planar support member. The support member is attachable to a rigid frame such as suitable location of a boat, and maintains the container of bilge cleaner in an upside-down orientation such that the bilge cleaner drips out of the dispenser by gravity directly into the boat's bilge at a preselected rate. A length of flexible tube can be utilized to direct the drips of bilge cleaner so that the container can be positioned in a convenient location.

The dispenser includes a first member having internal threads sized to mate with the bilge cleaner container's conventional external threads on the wall portion of the container's mouth. A disc shaped filter and a disc shaped seal are disposed between the container and the first member. The seal includes a calibration aperture for controlling the amount of liquid cleaner that can pass through the first member when the container is turned upside-down.

The first member can further include a section extending away from the container having external threads and a central aperture. A second member having internal threads can be mounted onto the external threads of the first member. The second member includes a central aperture. A packing member can be packed between the first member and the second member to further control the amount of liquid cleaner that can flow through the dispenser when the liquid bilge cleaner container is disposed in an upside-down orientation. The second member is rotatable in relation to the first member, and in conjunction with the packing member, provides "fine tuning" of the amount of liquid that can be dispensed from the container.

The amount of liquid bilge cleaner dispensed can be preselected to be any amount, and is controlled by the apertures in the first and second members, by the size of the aperture in the disk shaped seal, and by the packing pressure applied to the packing member by adjustment of the second member and first member together. A preferable rate of dispensing has been determined to be approximately 2 to 4 drops of cleaner per minute, for a suitable bilge cleaner such as available from Crew Cleaner, Inc., Pompano Beach, Fla. Any size container of bilge cleaner may be utilized with the present invention, but it is preferable to select a one gallon container.

Accordingly, it is an object of the present invention to provide a bilge cleaner dispenser and method that dispenses a preselected amount of liquid bilge cleaner into a bilge at a continuous rate over time.

In accordance with these and other objects which will become apparent hereinafter, the instant invention will now be described with particular reference to the accompanying drawings.

DETAILED DESCRIPTION OF THE INVENTION

Figure 1:
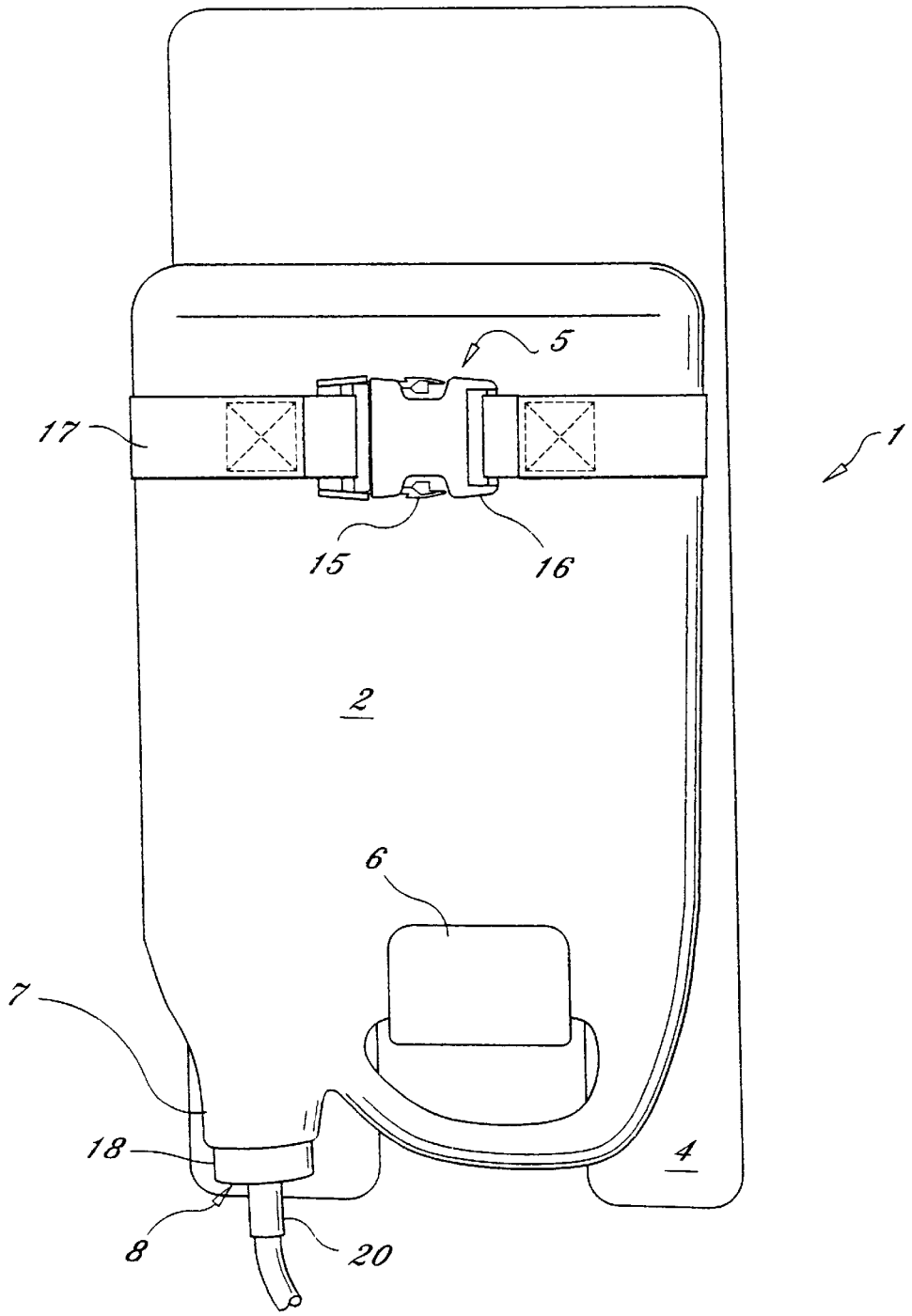
FIG. 1 is a perspective view of the present invention.

Referring to FIG. 1, the preferred embodiment of the present invention 1 includes a conventional container of a conventional liquid bilge cleaner 2 mounted to a substantially planar rigid support member 4. Container 2 is removably mounted to support member 4 in suitable manner such as by removable strap 5 and bendable tab member 6. Dispenser 8 acts as a flow regulator and is attached to conventional threads of mouth 7 of container 2. Support member 4 is mountable on a rigid frame such as a suitable portion of a boat and retains container 2 in an upside-down orientation, such that the liquid bilge cleaner drips out of dispenser 8 and into the boat's bilge.

Figure 2:
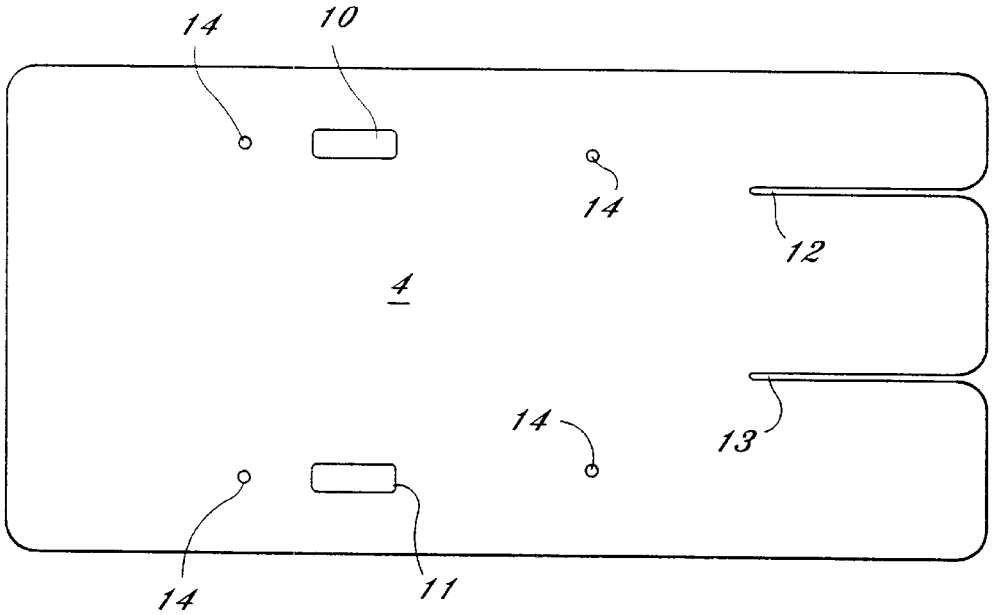
FIG. 2 is a top plan view of the substantially planar rigid support member of the present invention.

Referring to FIG. 2, support member 4 can be made of any suitable material, such as plexiglass, and can include a pair of apertures 10 and 11 sized to fit strap 5. A pair of slots 12 and 13 provide a cut out portion for bendable member 6, which can be bent to retain container 2 as illustrated in FIG. 1. Support member 4 can be mounted in a suitable position on a boat, and can include mounting holes 14 to facilitate mounting.

Figure 3:
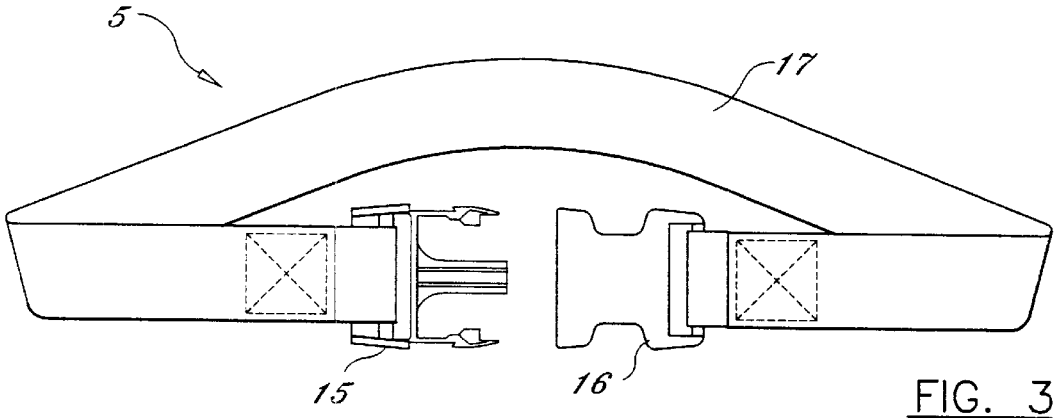
FIG. 3 is a perspective view of the mounting strap of the present invention.

Referring to FIG. 3, a suitable strap 5 can include male and female mating buckles 15 and 16, which can be plastic, connected to opposite ends of strapping 17 which can be made of nylon or other suitable material. Strap 5 is sized to snugly fit container 2, and may be elastic.

Figure 4:
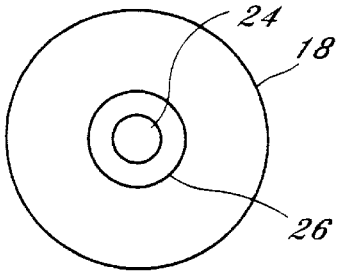
FIG. 4 is a bottom plan view of the first member of the dispenser of the present invention.
Figure 5:
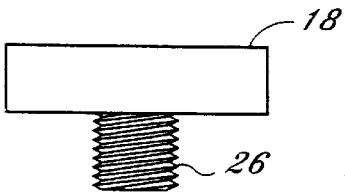
FIG. 5 is a side elevational view of the first member of the dispenser of the present invention.
Figure 6:
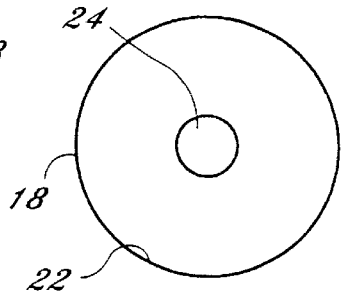
FIG. 6 is a top plan view of the first member of the dispenser of the present invention.

Referring to FIGS. 4, 5, and 6, the first member 18 of dispenser 8 is illustrated, and includes standard internal threads 22 which are mountable on the standard external threads on the mouth 7 of container 2. First member 18 further includes central aperture 24, and external threaded portion 26.

Figure 7:
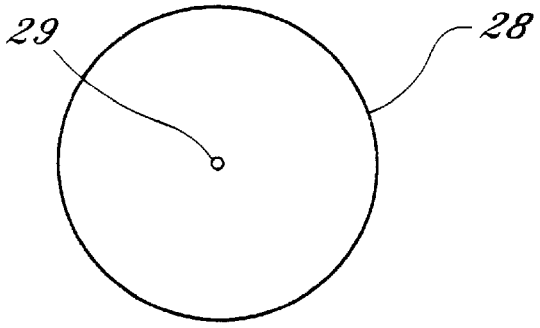
FIG. 7 is a top plan view of the disc shaped seal of the present invention.
Figure 8:
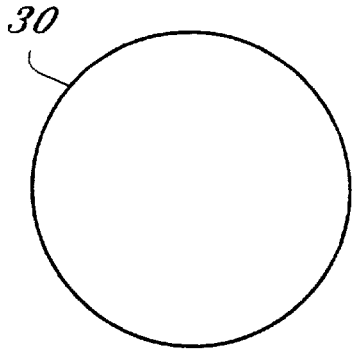
FIG. 8 is a top plan view of the disc shaped filter of the present invention.

Referring to FIG. 7, a disc shaped seal 28 includes central aperture 29. Referring to FIG. 8, disc shaped filter 30 can be a paper filter similar to a portion of a conventional coffee filter. Disc shaped filter 30 and disc shaped seal 28 are disposed between mouth 7 and first member 18. Aperture 29 is sized to provide passage therethrough of a preselected amount of bilge cleaner when container 2 is disposed in an upside-down orientation, and is preferably about 2 mm in diameter for the preferred embodiment described herein. The preferred embodiment includes a one gallon size container of bilge cleaner 2, such as available from Crew Cleaner, Inc., Pompano Beach, Fla.

Figure 9:
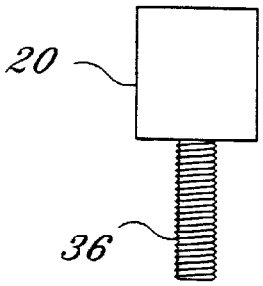
FIG. 9 is a side elevational view of the second member of the dispenser of the present invention.
Figure 10:
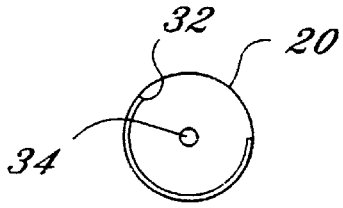
FIG. 10 is a top plan view of the second member of the dispenser of the present invention.
Figure 11:
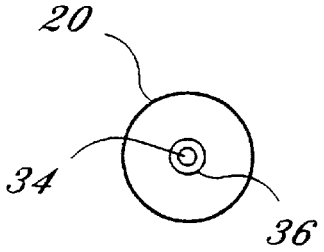
FIG. 11 is a bottom plan view of the second member of the dispenser of the present invention.

Referring to FIGS. 9, 10, and 11 the second member 20 of the dispenser 8 is illustrated and includes internal thread 32 sized to mate with external thread 26 on first member 18. Second member 20 further includes central aperture 34, sized about 2 mm in diameter in the preferred embodiment described herein. Nipple 36 can extend away from container 2 to direct the liquid cleaner as it is dispensed from container 2.

Figure 12:
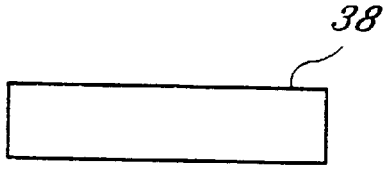
FIG. 12 is a top plan view of the packing member of the present invention.

Referring to FIG. 12, a packing member 38 can be disposed between first member 18 and second member 20 to further calibrate the drip rate of bilge cleaner from container 2 into the bilge. Second filter 38 can be custom cut and fit between first member 18 and second member 20 to provide, in combination with apertures 24, 29, and 34, and first filter 30, a continuous drip rate of approximately 2 to 4 drops per minute into a bilge when container 2 is disposed in an upside-down orientation. A length of conventional flexible tubing (not shown) can be connected at nipple 36 to direct the drips of bilge cleaner into the bilge so that support member 4 and container 2 can be positioned in a convenient location.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A liquid bilge cleaner dispenser comprising:

a substantially rigid support member mounted to a rigid frame;

a container fastener;

a liquid bilge cleaner container removably mounted to said support member by said fastener, wherein said container includes a wall portion forming a mouth, said mouth forming wall portion having exterior threads;

a liquid bilge cleaning flow regulator for dispensing a predetermined amount of said bilge cleaner wherein said flow regulator is attached to said mouth of said container;

said support member retains said container in an orientation to allow liquid flow by gravity from said container mouth; and wherein said flow regulator dispenses said predetermined amount of bilge cleaner without squeezing or applying pressure to said container.

2. A liquid bilge cleaner dispenser comprising:

a substantially rigid support member mounted to a rigid frame;

a container fastener;

a liquid bilge cleaner container removably mounted to said support member by said fastener, wherein said container includes a wall portion forming a mouth, said mouth forming wall portion having exterior threads;

a liquid bilge cleaning flow regulator for dispensing a predetermined amount of said bilge cleaner wherein said flow regulator is attached to said mouth of said container;

said support member retains said container in an orientation to allow liquid flow by gravity from said container mouth;

said container further comprises a handle defining a hollow opening and said container fastener comprises:

a removable strap encircling said container and said support member; and a bendable tab member extending from said support member and protruding through said hollow opening thereby securing said container to said support member.

3. A liquid bilge cleaner dispenser comprising:

a substantially rigid support member mounted to a rigid frame;

a container fastener;

a liquid bilge cleaner container removably mounted to said support member by said fastener, wherein said container includes a wall portion forming a mouth, said mouth forming wall portion having exterior threads;

a liquid bilge cleaning flow regulator for dispensing a predetermined amount of said binge cleaner wherein said flow regulator is attached to said mouth of said container; and said support member retains said container in an orientation to allow liquid flow by gravity from said container mouth;

said liquid bilge cleaner flow regulator comprises:

a first member with internal threads for mounting on said exterior threads of said mouth forming wall portion and an external threaded portion; and a second member with internal threads sized to mate with said external threaded portion of said first member.

4. The liquid bilge cleaner of claim 3 further comprising:

a disc shaped filter;

a disc shaped seal having a first central aperture wherein said filter and said seal are disposed between said mouth of said container and said first member; and said first central aperture is sized to provide passage therethrough of a preselected amount of said liquid bilge cleaner when said container is disposed in an orientation to allow liquid flow by gravity from said container mouth.

5. The liquid bilge cleaner dispenser of claim 4 wherein said second member includes a second central aperture having a diameter substantially equal in size to said first central aperture.

6. The liquid bilge cleaner dispenser of claim 5 wherein said first central aperture has a diameter of approximately 2 mm.

7. The liquid bilge cleaner dispenser of claim 1 further comprising a nipple protruding from said container to direct said bilge cleaner as said bilge cleaner is dispensed from said container.

8. The liquid bilge cleaner dispenser of claim 4 further comprising a packing member disposed between said first member and said second member to produce a continuous drip rate of said bilge cleaner from said container when said container is disposed in an orientation to allow liquid flow by gravity from said container mouth.

9. The liquid bilge cleaner dispenser of claim 8 wherein said continuous drip rate is approximately 2 to 4 drops per minute when said container is disposed in orientation to allow liquid flow by gravity from said container mouth.

10. The liquid bilge cleaner dispenser of claim 7 further comprising an elongated flexible tubing affixed to said nipple to direct said bilge cleaner into bilge such that said support member and said container can be positioned in a convenient location.

11. The liquid bilge cleaner dispenser of claim 8 wherein said second member is rotatable with respect to said first member, to allow a user to adjust the amount of said bilge cleaner that can be dispensed from said container.

12. The liquid bilge cleaner dispenser of claim 11 wherein said amount of bilge cleaner dispensed from said container is controlled by said first and second central apertures and by pressure applied to said packing member by adjustment of said first and second members.

13. A liquid bilge cleaner dispenser comprising:

a substantially rigid support member mounted to a rigid frame;

a liquid bilge cleaner container having a handle defining a hollow opening;

a container fastener comprising a removable strap encircling said container and said support member, and a bendable tab member extending from said support member and protruding through said hollow opening thereby securing said container to said support member;

said support member retains said container in an orientation to allow liquid flow by gravity from said container mouth;

said container is removably mounted to said support member by said fastener wherein said container further includes a wall portion forming a mouth, said mouth forming wall portion having exterior threads;

a disc shaped filter;

a disc shaped seal having a first central aperture having a diameter of approximately 2 mm wherein said filter and said seal are disposed between said mouth of said container and said first member;

said first central aperture is sized to provide passage therethrough of a preselected amount of said bilge cleaner when said container is disposed in an orientation to allow liquid flow by gravity from said container mouth;

a liquid bilge cleaner flow regulator for dispensing a predetermined amount of said bilge cleaner wherein said flow regulator is attached to said mouth of said container, said flow regulator comprises a first member with internal threads for mounting on said exterior threads of said mouth forming wall portion and an external threaded portion, and a second member with internal threads sized to mate with said external threaded portion of said first member wherein said second member further includes a second central aperture having a diameter substantially equal in size to said first central aperture;

a nipple protruding from said container to direct said bilge cleaner as said bilge cleaner is dispensed from said container;

a packing member disposed between said first member and said second member to produce a continuous drip rate of said bilge cleaner from said container when said container is disposed in an orientation to allow liquid flow by gravity from said container mouth, wherein said continuous drip rate is approximately 2 to 4 drops per minute;

an elongated flexible tubing affixed to said nipple to direct said bilge cleaner into bilge such that said support member and said container can be positioned in a convenient location; and said second member is rotatable with respect to said first member to allow a user to adjust the amount of said bilge cleaner that can be dispensed from said container wherein said amount of bilge cleaner dispensed from said container is controlled by said first and second central apertures and by pressure applied to said packing member by adjustment of said first and second members.

14. A method for dispensing bilge cleaner comprising the steps of:

filling a container with a liquid bilge cleaner wherein said container includes at least one opening for recovery or dispensing of said liquid bilge cleaner;

mounting said container to a substantially rigid support member with said container opening facing downwardly;

attaching an adjustable liquid drip flow control dispenser to said container opening wherein said control dispenser comprises a first member in mating relationship with a second member and wherein said bilge cleaner liquid flows through a central aperture situated within a disc shaped seal disposed between said container opening and said first member; and adjusting the amount of said liquid bilge cleaner that can be dispensed from said container to a predetermined number of drops per unit time.

15. The liquid bilge cleaner dispenser of claim 3 further comprising a packing member disposed between said first member and said second member to produce a continuous drip rate of said bilge cleaner from said container when said container is disposed in an orientation to allow liquid flow by gravity from said container mouth.

16. The liquid bilge cleaner dispenser of claim 15 wherein said continuous drip rate is approximately 2 to 4 drops per minute when said container is disposed in orientation to allow liquid flow by gravity from said container mouth.

17. The liquid bilge cleaner dispenser of claim 15 wherein said second member is rotatable with respect to said first member, to allow a user to adjust the amount of said bilge cleaner that can be dispensed from said container.

* * * * *